US007028848B2

(12) United States Patent
Bozzato

(10) Patent No.: US 7,028,848 B2
(45) Date of Patent: Apr. 18, 2006

(54) FEEDING METHOD AND APPARATUS FOR DYNAMIC SEPARATORS

(75) Inventor: Paolo Bozzato, Masontown, WV (US)

(73) Assignee: Ecomin SRL, Genova (IT)

( * ) Notice: Subject to any disclaimer, the term of this patent is extended or adjusted under 35 U.S.C. 154(b) by 107 days.

(21) Appl. No.: 10/331,115

(22) Filed: Dec. 23, 2002

(65) Prior Publication Data

US 2003/0127374 A1 Jul. 10, 2003

Related U.S. Application Data

(63) Continuation of application No. PCT/EP01/04602, filed on Apr. 24, 2001.

(30) Foreign Application Priority Data

Jun. 26, 2000 (IT) ..... MI2000A1429

(51) Int. Cl.
*B04C 3/06* (2006.01)

(52) U.S. Cl. ..... 209/724; 209/730; 209/734; 209/725; 209/729; 210/512.1; 210/512.2; 210/512.3

(58) Field of Classification Search ..... 209/724, 209/725, 727, 728, 729, 730, 731, 734; 210/512.1, 210/512.2, 512.3
See application file for complete search history.

(56) References Cited

U.S. PATENT DOCUMENTS

| | | | | |
|---|---|---|---|---|
| 2,645,346 | A | 7/1953 | Staege et al. | |
| 2,843,265 | A | 7/1958 | Rakowsky | |
| 4,216,095 | A * | 8/1980 | Ruff | 210/512.1 |
| 4,271,010 | A * | 6/1981 | Guarascio | 209/724 |
| 5,819,945 | A * | 10/1998 | Laskowski et al. | 209/2 |
| 6,596,169 | B1 * | 7/2003 | Rong et al. | 210/512.1 |

FOREIGN PATENT DOCUMENTS

| | | |
|---|---|---|
| DE | 756198 | 8/1956 |
| GB | 33 22 700 A1 | 1/1985 |
| GB | 2 164 589 | 3/1986 |
| GB | 36 34 323 | 4/1988 |
| WO | WO 00/29123 | 5/2000 |

* cited by examiner

*Primary Examiner*—Donald P. Walsh
*Assistant Examiner*—Jonathan R Miller
(74) *Attorney, Agent, or Firm*—Katten Muchin Rosenman LLP

(57) ABSTRACT

The invention relates to an axial feeding method of the material to be separated in a dense-medium dynamic separator (1). This method is based on the principle of imparting to the material and to the fluid in which it is dispersed, in order to facilitate introduction thereof into the separator (1), a rotational velocity component with respect to the axis of the latter, in this way the particles of material have a movement corresponding to that of the dense medium circulating in the separator, so as to prevent uncontrolled dispersion of the particles inside it. The invention also comprises a feeding apparatus (2) for carrying out the abovementioned method.

13 Claims, 2 Drawing Sheets

FEEDING METHOD AND APPARATUS FOR DYNAMIC SEPARATORS

This application is a continuation of international application number PCT/EP01/04602 filed on Apr. 24, 2001.

According to a more general aspect, the present invention relates to dense medium dynamic separators used for the separation of solid particles such as granules of minerals in broad sense (for example limestone, coal or others) and intended in particular, but not exclusively, for mine applications.

These separators may be either those with a single stage, also known as "dyna whirlpools", either their subsequent improvements with multiple stages like that described in U.S. Pat. No. 4,271,010 in the name of Guarascio, or based on the teaching of this patent.

In short, these separators have one or more stages each consisting of a chamber with a preferably cylindrical geometry for separation of the solid particles, provided with two openings arranged along its longitudinal axis: the first opening is used for introduction of the material to be separated and the second is used as an outlet for a fraction of the separated material. A separating fluid with a predefined density, also called dense medium, is circulated inside the chamber.

This fluid is generally a water suspension of magnetite and/or ferrosilicon; it is introduced tangentially into the cylindrical chamber in the vicinity of the second axial opening for the outlet of the separated material, so as to turn round in the separator and create a field of centrifugal forces, following at the same time a counter-flowing spiral path with respect to the material to be separated. The dense fluid or medium, together with the heavier particles, then comes out tangentially from the separation chamber in the vicinity of the axial inlet opening for the feeding of the material to be separated.

According to the operating principles of these separators, the heavier solid particles contained in the initial material are dispersed by means of centrifugal force along the spiral path of the dense medium, by which they are conveyed towards the said tangential outlet.

The lighter particles, on the other hand, cumulate along the axis of the separation chamber and emerge from its second axial opening referred to above; it must be pointed out here that the density of the dense medium is suitably chosen so that the lighter particles may "float" thereon, while arranging themselves along the axis of the separator.

The improvement described in the US patent mentioned above, consists in the fact that the separator is composed of two stages like the one just described, arranged in series with each other.

In other words, the flow of separated lighter particles which emerges axially from the first cylindrical chamber, enters into a second chamber similar to the first one and arranged downstream thereof, where it meets another dense medium which performs a further separation in accordance with the same operating principle already explained.

If the dense medium circulating in the second chamber is the same of that in the first chamber, the final result is that a more thorough separation inside the second stage is achieved, which allows to obtain particles of one type without impurities.

If, on the other hand, the dense medium of the second stage is different from that of the first stage, it is possible to obtain the separation of three different kinds particles present in a same initial mixture.

In the present centrifugal separators, the step involving introduction of the initial solid material to be separated is of considerable importance: indeed the proper efficiency of the first (or single) stage and, consequently, of the entire separator depends thereon.

For this purpose it is known nowadays to disperse the initial material, together with a certain volume of dense material, already outside of the separator; in other words, the solid material is not introduced "dry" into the separator, but is instead dispersed with a small fraction of the dense medium, which merges into the main flow circulating inside the separation chamber.

This may be done, for example, by introducing into the same feed hopper of the separator, the dense medium and the material to be separated in controlled proportions.

The part of dense medium used to disperse the initial solid material before entering into the separator, is commonly know as "fluxing" in order to distinguish it from that fed into the separation chamber, which is instead called the "main" dense medium.

In the current separators the fluxing with the solid material to be separated dispersed therein, enters axially into the separator where it meets the main dense medium circulating therein.

However, in the case where the particles of the material have chemical and physical properties (type, weight and size) such as to make introduction thereof difficult because they tend to obstruct the axial inlet of the separator, namely the first opening referred to above, it is necessary to add in the hopper a suitable quantity of fluxing medium in order to disperse said particles more thoroughly before entering into the separator.

This may, however, modify the operating conditions inside the separator excessively, resulting in a reduction in the efficiency thereof; in other words, if the fluxing is increased too much, the balance with the main dense medium flowing inside the separator chamber is altered, so that the system does not operate anymore under uniform operating conditions.

On the other hand, if in order to prevent the feeding interruption due to the obstruction produced by the particles of solid material, the volume of the latter fed into the hopper is reduced, it results that the efficiency of the system decreases because the energy in any case required for tangential pumping of the dense medium inside the cylindrical chamber does not produce a corresponding quantity of separated particles.

In other words, for the same energy used for pumping of the dense medium, there is a lower yield of separated material.

It is therefore the object of the present invention to remedy this situation; namely it aims at devising a method for feeding the material to be separated in dynamic separators of the type considered above, suitable to overcome the limits shown by the state of the art.

This object is achieved by a method, whose operating steps are stated in the appended claims.

The invention also comprises a feeding apparatus for implementing this method, whose features are also stated in the following claims.

The invention will be better understood in the light of the description provided hereinbelow, in connection with two preferred but not exclusive embodiments of the feed device according to the invention, illustrated in the accompanying drawings in which.

Figure 1:
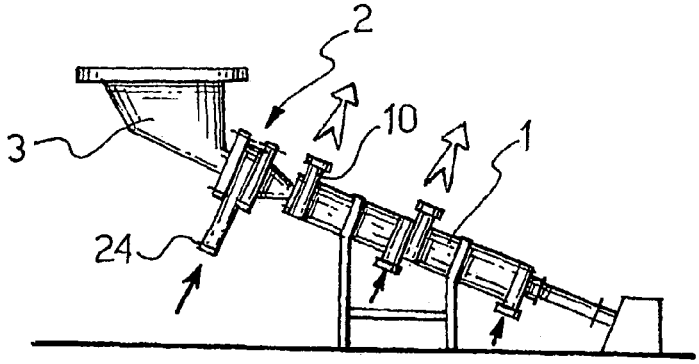
FIG. 1 shows schematically a dynamic separator of the two-stage centrifugal type, to which a first example of a feeding apparatus according to the invention is applied.

Starting with the first of these figures, numeral 1 denotes a centrifugal separator of the type described in the already mentioned U.S. Pat. No. 4,271,010 to Guarascio; this separator will therefore not be considered in greater detail below and reference should be made in this connection to what is disclosed in the abovementioned patent, which is hereby incorporated by reference.

The separator 1 is installed with its longitudinal axis inclined and has an usual tangential outlet 10 for the heavier separated particles, in the vicinity of its axial inlet end; the feeding apparatus 2 according to this invention is situated upstream of the separator 1, underneath a hopper 3.

The latter is filled from above with particles of material to be separated, which flow by gravity either with or without the addition of fluxing.

The hopper 3 terminates at the bottom in a tubular duct 3*a* which extends partially into a frustoconical chamber 20 of the feeding apparatus 2.

This chamber 20 is fixed to the hopper 3 with a two flange joint 21 and 22, in the region of which there is a tangential inlet pipe 24 for feeding the fluxing into the chamber 20, i.e. a certain amount of dense medium which is of the same nature as that circulating inside the first stage of the separator 1 downstream the chamber 20.

Obviously, the connection between the chamber 20 and the hopper 3 or the mounting of the tangential inlet pipe 24 may be done using systems different from the abovementioned two flange joint.

The feeding apparatus 2 introduces the material to be separated inside the first stage of the separator 1, by means of a tubular manifold 25 which extends partially into it and is joined to the tapered end of the chamber 20 by means of a flange 26. Obviously the manifold 25 may in any case be formed as one piece with the chamber 20 or joined thereto in other ways different from the flanged joint considered here.

From the functional point of view, the feeding apparatus 20 operates as described below.

The material to be separated, contained in the hopper 3, enters into the frustoconical chamber 20 passing through the duct 3*a* of the latter; inside the chamber 20 it encounters the dense flow medium which is fed from the tangential pipe 24 and which produces a spiral-like circulation of fluid towards the manifold 25.

As a result the material to be separated which is dispersed in the dense medium performs volutes with a decreasing diameter inside the frustoconical chamber 20, so that when it enters into the separator 1 at the outlet of the header 25, its particles already have a rotational speed component with respect to the axis of the separator (in addition to a component of movement along this axis) which allows optimum separation of the particles.

In particular, according to the present invention the rotational speed component imparted by the feeding apparatus 2 to the flow medium and to the particles of material dispersed therein, preferably corresponds to that of the main dense medium circulating inside the separator 1: as a result it is possible to prevent possible changes in the operating conditions present inside the latter, for improving its performance.

As can be seen, therefore, owing to this effect of dynamic pre-dispersion of the material to be separated inside the chamber 20, it becomes possible to overcome the problems of the prior art relating to the introduction of material into the separator.

Indeed, now the material which descends from the hopper 3, is not only diluted by the fluxing so as to facilitate introduction thereof into the separator 1, but is also accelerated by it so that when the particles enter into the separator, they are not subject to a sudden impact with the fluid circulating inside the latter; indeed this would produce operating conditions that lower the separating capacity of the system.

On the other hand, since the particles present in the fluxing hate a rotational speed component with respect to the axis of the separator, they can flow into the main dense medium circulating inside it without undergoing an uncontrolled dispersion which would make subsequent separation thereof problematic.

In this connection it can also be appreciated that by regulating the flowrate (and therefore the speed) of the dense medium fed inside the pipe 24, the abovementioned rotational speed component of the particles dispersed in the fluxing is also regulated, so as to control effectively the operating conditions at the inlet of the separator 1 as required.

Figure 3:
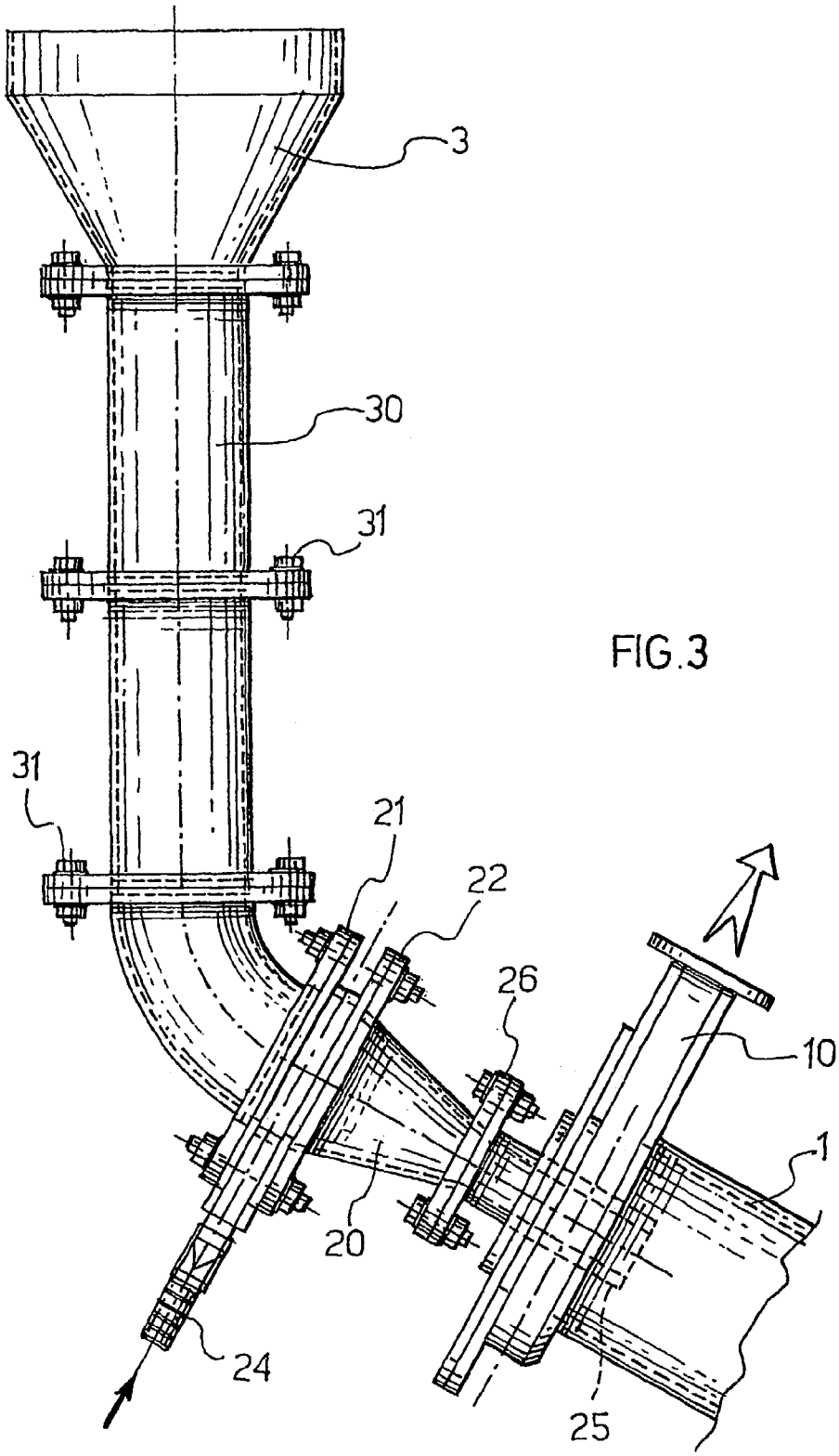
FIG. 3 is a schematic view similar to that of FIG. 1 and relating to a centrifugal separator to which a second example of feeding apparatus in accordance with the invention is applied.

Considerations similar to those set forth heretofore are also applicable to the second embodiment of the invention shown in FIG. 3, in which parts structurally or functionally equivalent to those already considered above are indicated by the same numbers and will not be described in further detail.

Basically it may be said that this second embodiment differs from the first one in that there is no longer the duct 3*a* of the hopper 3, so that the entire section of the larger base of the frustoconical chamber 20 may be used for the introduction of the material to be separated, inside the feeding apparatus 2.

Furthermore, in accordance with a preferred embodiment a tubular column 30 arranged with a predefined inclination with respect to the vertical, which may be optimised following the material to be separated, is inserted between the hopper 3 and the feeding apparatus 2; this column is advantageously formed by interchangeable modules are connected together by means of flanged joints 31.

During operation the column is partially or totally filled with fluxing medium inside which the particles of material to be separated are dispersed, and thus keeps the device 2 under a hydraulic head.

In this embodiment of the invention, the particles of material to be separated (with the dense medium in which they are dispersed, if any) supplied from the hopper 3, are set in rotation inside the feeding chamber 20 by the dense medium fed tangentially from the pipe 24.

In this way the same conditions as those of the preceding example are obtained, so that the particles and the fluxing enter into the separator with a rotational speed component having the same direction of that of the main dense medium.

Of course variations of the invention with respect to the exemplifying embodiments thereof described here, are possible.

First of all it must be pointed out that the feeding method and the associated devices considered above may be used not only in two-stage, but also in single-stage centrifugal separators, as well as, more generally, in all axially feeded separators.

Second it must be pointed out that the manners by means of which the rotational speed is conferred to the fluxing and, consequently, to the material to be separated, may differ considerably from those of the preceding examples.

In other words, in the embodiments shown in the drawings this speed component is obtained by feeding the fluxing medium (wholly or partly, depending on the solution) tangentially into the frustoconical chamber 20, by means of the pipe 24.

The rotary motion of the fluid could however already be obtained, wholly or partly, inside the hopper 3, thereby making it possible to eliminate the pipe 24 for tangential introduction of the fluxing medium inside the chamber 20 or reduce the amount of the fluxing medium introduced, depending on the circumstances.

Moreover it should be pointed out that the aforementioned motion may be obtained in various other ways including, obviously, also that of using more than one tangential pipe in the feeding chamber 20, instead of the single one shown in the drawings.

One of these ways could, for example, consist in providing a mixer with a helical vane (or helical vanes) axially inside the feeding apparatus 2; with this solution it would also be possible to consider to eliminate the pipe 24 for tangential feeding of the fluxing, which instead could be introduced only axially into the device 2, as occurs in the case of FIG. 3 with the column 30.

Another possible way of obtaining a rotational speed component for the fluid which enters the separator 1, would be that of providing a feeding chamber communicating axially with the separator and consisting of a pipe, a cylindrical drum or the like, rotating about its longitudinal axis; in this case by causing the chamber to rotate, the supplied (axially) therein would also be set in rotation, so as to obtain the same effects already described above.

In at least one embodiment the rotational speed component is imparted using a chamber rotating about the axis of the separator (1) and communicating therewith.

Another important manner of carrying out the invention may be obtained without using a specific feeding apparatus per se as in the examples described, but using instead a separator stage for this purpose; this solution may therefore be advantageously applied to already existing and installed separators, without the need to make an excessive amount of modifications thereto.

Indeed, in the case of separators with two or more stages such as those described in U.S. Pat. No. 4,271,010 to Guarascio, the second, and more generally the nth, stage arranged in series may be fed using the stage immediately upstream likewise the feeding chamber of the device 2 described hereinabove.

Figure 2:
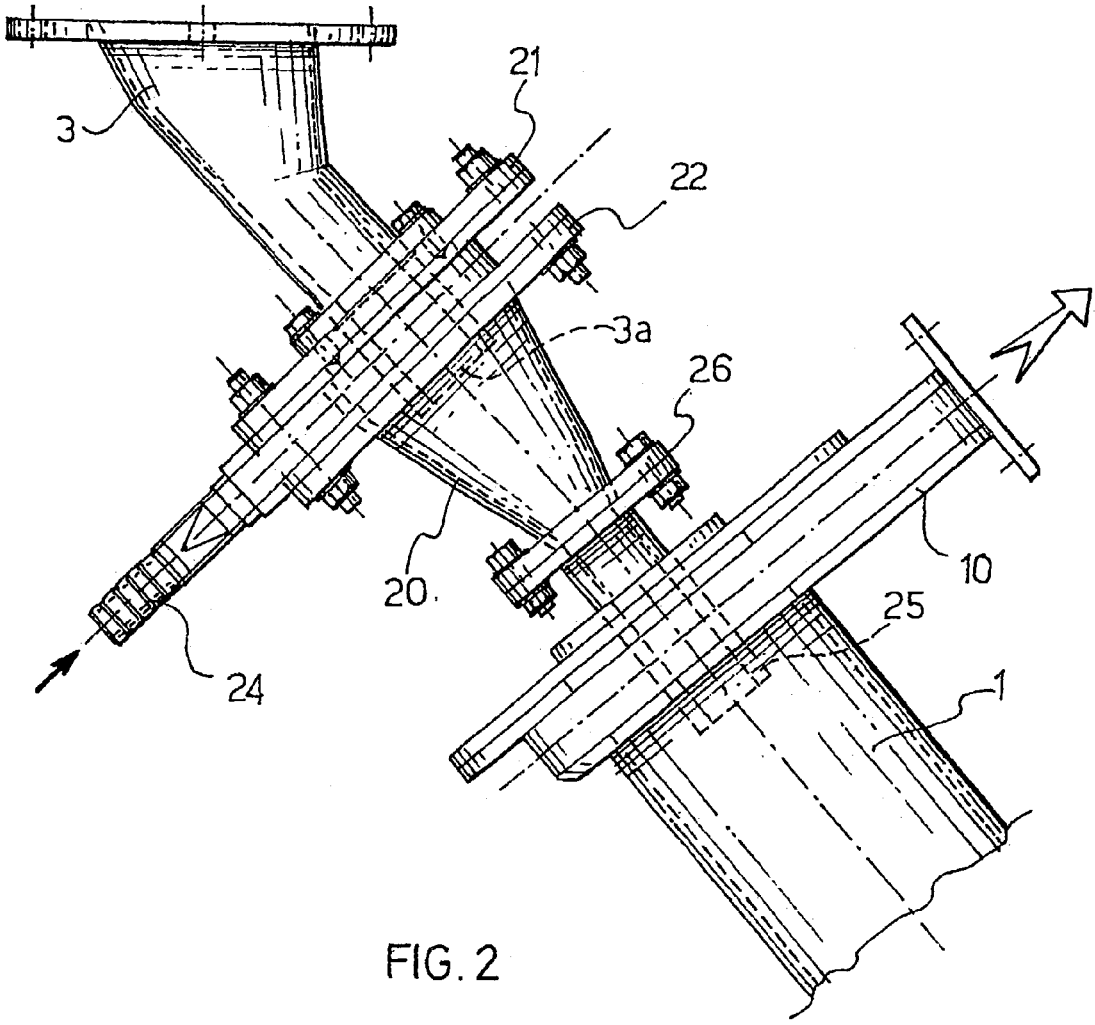
FIG. 2 shows in detail the feeding apparatus visible in FIG. 1.

For this purpose it will be sufficient to eliminate or simply close (for example by means of a common valve) one of the two tangential ducts of the upstream stage, using the other duct (for example the pipe indicated by 10 in FIGS. 2 and 3) for tangential introduction of the fluxing likewise the pipe 24 in the preceding examples.

In other words, with this solution the separator of the abovementioned patent would be used as a single-stage separator, wherein the first stage works as a feeding apparatus for the second stage.

It is however fully evident that this manner of operation may be used independently of the presence of a special feeding apparatus upstream of the separator: that is to say, further to being applied on already installed separators without this device, the aforementioned manner of operation may also be used in separators quipped with the device (such as that illustrated in FIG. 1), therefore increasing their applicability since they may be adapted to fit best the different operating situations which may occur in practice.

As can be appreciated, therefore, the present invention is quite flexible functionally and can therefore be implemented in several different ways: consequently the feeding chamber may be subject to relevant changes with respect to the frustoconical shape in the examples illustrated.

It must be stated, however, that this tapered shape allows efficient conveying of the fluxing and the particles dispersed therein, towards the header 25 which extends along the axis of the separator 1.

Moreover it facilitates the tangential introduction into the chamber 20 of the fluxing medium, which for this reason is taken in at the larger base of its frustoconical shape.

Last it should be added that the method according to the present invention may be advantageously carried out also in combination with feeding of the material to be separated, performed tangentially with respect to the separator.

Indeed, it is known in some cases to introduce the particles of material to be separated, dispersing them directly in the flow of main dense medium which is taken in by one of the tangential ducts present in the separator 1 (visible in FIG. 1).

However, this method of feeding is performed only by way of alternative to axial feeding, i.e. not in combination therewith, because this would reduce the separating capacity of the system.

Now, however, owing to the control of the axial feeding of the particles obtained by imparting to them a rotational speed in accordance with the method of the present invention, it is possible to perform at the same time also tangential introduction of material to be separated with the main dense medium circulating in the separator.

In accordance with at least one embodiment, part of the material to be separated is fed tangentially into the separator (1) together with the main dense medium circulating inside it.

This therefore allows, other conditions remaining unchanged, the quantity of separated material to be increased.

All these and other possible variations nevertheless fall within the scope of the claims which follow.

The invention claimed is:

1. A method of feeding material to be separated into a dense medium dynamic separator comprising at least one separating stage, the method comprising the steps of:

a) introducing particles of material to be separated using a fluid fluxing medium, the particles of material being introduced along a longitudinally ditected forward flowline of the particles of material with respect to the separator;

b) imparting a rotational speed component with respect to the forward flowline to the fluxing medium and to the particles of materials dispersed therein when both are in a feeding chamber; and c) passing all of the fluxing medium and the particles of materials into the at least one separating stage.

2. The method of claim 1 wherein the rotational speed component is concordant with that of a main dense medium circulating in the separating stage.

3. The method of claim 1 wherein the rotational speed components is imparted by supplying at least in part the fluxing medium tangentially with respect to the feeding chamber, the feeding chamber being arranged upstream of the separating stage and being in axial communication therewith.

4. The method of claim 3, wherein the feeding chamber tapers toward the separating stage.

5. The method of claim 4, wherein the feeding chamber is frustoconical.

6. The method of claim 1, wherein the rotational speed component is imparted using a mixer comprising at least one helical vane, the mixer being arranged along a path of the fluxing medium upstream in the separating stage.

7. The method of claim 1, wherein the rotational speed component is imparted using a chamber rotating about an axis of the separating stage and communicating therewith.

8. The method of claim 1, wherein part of the material to be separated is fed tangentially into the separating stage together with the main dense medium circulating inside it.

9. A feeding system for a dynamic separator for use with a dense medium, the feeding system comprising:

a separating stage for separating particles of materials;

a hopper for storage of the particles of materials;

a feeding chamber communicating along a forward flow-line with the separator and upstream with the hopper; and at least one pipe having a first end disposed in the feeding chamber tangentially with respect thereto for supplying fluxing medium to the feeding chamber, the fluxing medium imparting a rotational speed component to the particles of material, the rotational speed component being maintained for passage of the fluxing medium and the particles of material into the separating stage.

10. The feeding system of claim 9, wherein the feeding chamber is frustoconical.

11. The feeding system of claim 9 wherein the hopper is connected to the feeding chamber by means of a column having one of a predefined height and inclination with respect to the vertical.

12. The feeding system of claim 11, wherein the column is formed using modular elements joined together in a removable manner.

13. A feeding system for a dynamic separator, the feeding system comprising:

a hopper for discharging particles of materials;

a feeding chamber communicating wit the separator downstream and communicating with the hopper upstream;

a first pipe disposed in the feeding chamber tangentially with respect thereto for supplying a fluxing medium to the feeding chamber, the fluxing medium imparting a rotational speed component to the particles of material, the rotational speed component being maintained for passage of the fluxing medium and the particles of material into the separator; and a second pipe disposed in the feeding chamber for passing particles of material from the hopper to the feeding chamber.

* * * * *